US006273251B1

(12) United States Patent
Rust

(10) Patent No.: US 6,273,251 B1
(45) Date of Patent: Aug. 14, 2001

(54) TRAVEL PROTECTOR FOR GOLF CLUB HEADS

(76) Inventor: Tim Rust, 83 Lakeview Dr., Alloways, NJ (US) 08001

( * ) Notice: Subject to any disclaimer, the term of this patent is extended or adjusted under 35 U.S.C. 154(b) by 0 days.

(21) Appl. No.: 09/556,992

(22) Filed: Apr. 24, 2000

(51) Int. Cl.[7] ..... A63B 55/00

(52) U.S. Cl. ..... 206/315.4; 206/315.3; 150/159

(58) Field of Search ..... 206/315.3, 315.4; 150/159, 160

(56) References Cited

U.S. PATENT DOCUMENTS 4,512,465 * 4/1985 Jobe ..... 206/315.4
4,789,996 * 12/1988 Forshee ..... 206/315.4 X
5,209,280 * 5/1993 Gevas ..... 206/315.4 X
5,738,208 * 4/1998 Roubal ..... 206/315.4
5,762,188 * 6/1998 Nishimura ..... 206/315.4
6,029,813 * 2/2000 Smolenski ..... 206/315.4

* cited by examiner

*Primary Examiner*—Sue A. Weaver
(74) *Attorney, Agent, or Firm*—Jeffrie J. Keenan

(57) ABSTRACT

A travel protector for golf club heads comprising a structurally sturdy assembly, including multiple leg members arced over and encasing entire top of a golf bag and connected and secured thereto. The invention is fitted with padding abutting and protecting the golf club heads within the golf bag.

6 Claims, 2 Drawing Sheets

TRAVEL PROTECTOR FOR GOLF CLUB HEADS

FIELD OF INVENTION

This invention related to protection for golf club heads positioned in a golf bag during transit conditions.

BACKGROUND OF THE INVENTION

During the course of travel, golf clubs can experience damage or breakage due to the physical nature of golf bag handling. Golf clubs are generally transported with standard golf bag head covers, which afford only minimal transit protection and are not specifically designed to stem golf club damage. In response to this problem, a number of golf bags and golf bag covers have been produced to address this issue; however, none has met with commercial success due either to cumbersome design or high manufacturing costs. The benefit of the present invention is that the existing golf bag can be used therefore eliminating the prior art disadvantage of not being able to accommodate a variety of golf bags designs.

Various types of golf bag protection have been proposed in the prior art. Examples are found in U.S. Pat. Nos. 5,862,910 and 5,904195. None of these patents discloses a device wherein the chief goal is transit protection and is of simple means to ensure commercial success or economic viability. This invention makes use of multiple leg members secured to a golf bag converging to a common integrated apex, comprising of a plate and lip, above the golf bag opening and golf club heads. This structure is provided with under padding to absorb impact and reduce shock caused during transit to the golf clubs heads. There is no need to purchase a separate golf bag or golf bag cover as said structure accommodates the existing golf bag cover. Therefore, this invention is simple and inexpensive to manufacture and does not require a costly equipment bag upgrade.

SUMMARY OF THE INVENTION

This invention relates to a protective transit cover for protection of golf club heads. Protective covers for golf bags are known in the prior art, as shown for example in U.S. Pat. Nos. 5,862,910 and 5,904195. Such prior art has met with limited commercial success due to being overly complex and costly, not providing sufficient shock protection and/or requiring substantial overall equipment upgrade cost to the golfer. This invention overcomes the weaknesses of the prior art by devising a simple mechanical design that not only provides ample golf club head protection, but obviates the need for the golfer to invest in an equipment upgrade as the invention is compatible with a wide range of standard or oversized golf bags. A further advancement of this invention its ability to be collapsed and easily stowed away when not in use.

The present invention discloses a protective transit cover for protection of golf club heads having multiple rigid metallic legs attachable by securing means at various levels to a golf bag, the legs culminate at a common apex, comprising a rigid plate and lip arrangement, above golf club heads. The underside of the rigid plate with lip is fitted with shock adsorbing padding material to limit mechanical agitation shock to the golf clubs caused by transit conditions.

Such securing means includes use of clips that are attached directly to the golf bag at various adjustable levels. The entire invention assemble is sized to fit securely over standard and oversized golf bag covers.

This invention provides a double layer of protection to the golf club heads which augments the cosmetic protection afforded by the standard bag cover. The first level of protection is provided by the shock absorbing material which limits blunt force damage. The second level of protection is provided by the rigid assembly in protecting against deformation caused by crushing or crowding of a golf bag.

BRIEF DESCRIPTION OF THE DRAWINGS

In order that the invention may be readily understood a preferred embodiment of the invention will be described by way of example, with reference to the accompanying drawings within.

DETAILED DESCRIPTION OF PREFERRED EMBODIMENT

Figure 1:
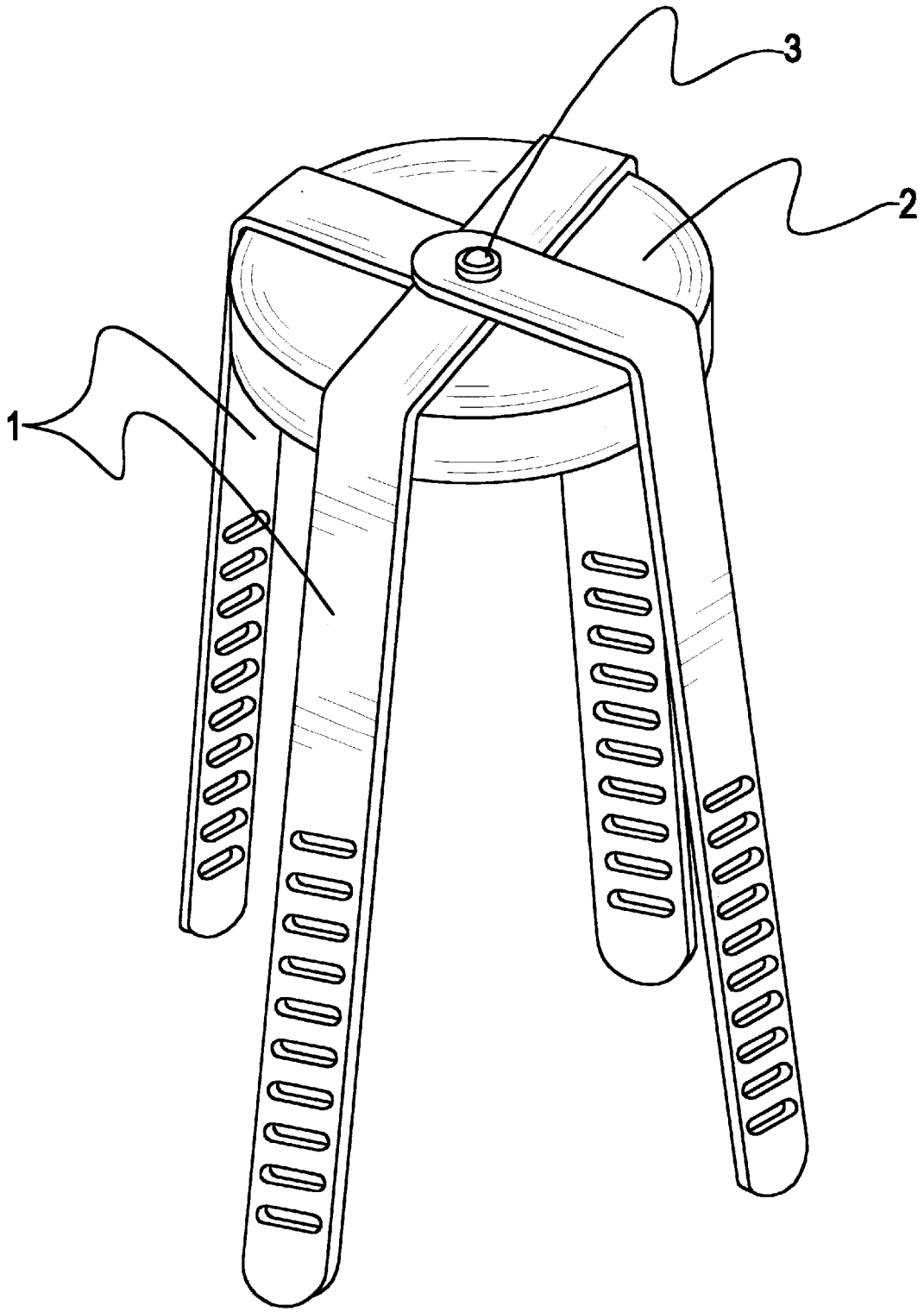
FIG. 1 is a front elevation view of the assembly, in particular showing the plate and lip arrangement, including stud and bolt, and a plurality of legs attachable to the golf bag frame.
Figure 2:
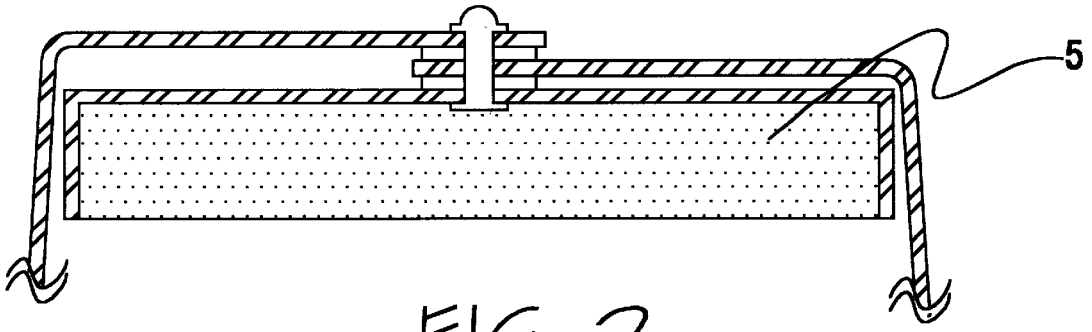
FIG. 2 is a cross section view of FIG. 1, showing the padding material provided under the plate and lip arrangement.

With reference to FIG. 1, the preferred embodiment of the invention provides multiple rigid metallic legs (1) with multiple securing slots provided at one end (6). Said legs (1) raise parallel to the internal frame of the golf bag and at the opposite end of said slotted end are angled inward and joined by stud and bolt arrangement (3). Plate with lip are shown as (2) with a central stud and bolt arrangement (3). The plate portion extending circumferentially outward to the angled inward leg portion with the lip extending downward approximately two to five inches along the leg toward the slotted end. The plate and lip structure (2) is designed as an end shield to limit golf club movement during transit. As shown in FIG. 2, said plate and lip structure (2) being fitted with padded foam material (5) to further soften any mechanical damage to the golf club heads. The entire structure preferable is constructed with sheet metal material; however may be constructed with other suitable rigid material, including plastics.

Figure 3:
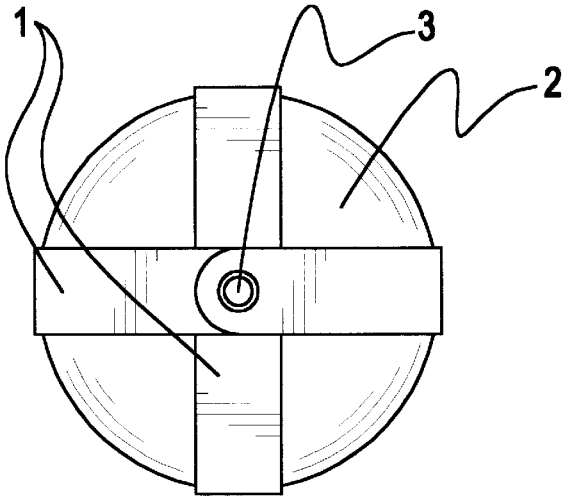
FIG. 3 is a top view of the assembly showing leg arrangements as joined at stud and bolt.

In accordance with the invention, and shown in FIG. 3, said plate and lip member (2) is attached by stud and bolt (3), abutted and fitted snuggly against leg member and contoured with leg member approximately two to five inches below angled leg portion running parallel to golf bag. The plate with lip member (2) is sized to mate with leg members and receive padded shock adsorbing material (5).

Figure 4:
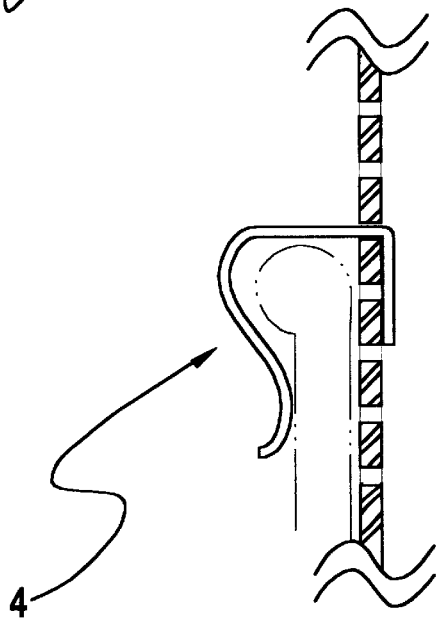
FIG. 4 is a cross section view showing the clip and leg attachment arrangement.

An attachment means, as shown in FIG. 4, is provided to secure the lower leg members to the golf bag. In the preferred embodiment the lower leg members are fitted with numerous slots and clips (4), such that when clips (4) are inserted in said slots a means to clamp is thereby provided for engagement between lower leg elements and the golf bag. Such attachments means is not limited to a clip arrangement, other acceptable methods may be utilitized. In the preferred embodiment, multiple slots ensure a wide range of adaptability to many golf bag designs; however, custom applications embodiments may have singular or more limited slot arrangements. A further feature, not shown, is a securing strap provided between the clip (4) and the lower leg elements that provides for greater stability in assuring that the golf club protector structure remains secured and in place on the golf bag. Another feature, is the ability to collapse the member legs by loosing the bolt thereby providing stowage of the invention.

I claim:

1. A golf club head protector assembly designed to prevent golf club damage during transit conditions, comprising: a plurality of rigid legs spaced circumferentially around a golf bag opening rim attached on one end to the golf bag by securing means and extending upward along the inside of the golf bag, beyond the golf bag opening, and then angled inward around a rigid plate having a lip and central stud, said plate mated and joined against said legs by bolt and said stud and sized to fit an entire pocket created by said legs, said legs other end culminating at said stud, said plate under portion fitted with padded material.

2. A golf club head protector assembly according to claim 1, wherein said securing means comprises slots on said leg elements mated with clips that attach on golf bag.

3. A golf club head protector assembly according to claim 1, wherein said plate has said lip of two to five inches.

4. A golf club head protector assembly according to claim 1, wherein said padded material is, comprised of one inch thick Styrofoam (expanded rigid polystyrene plastic).

5. A golf club head protector assembly according to claim 1, wherein said bolt and said stud arrangement can be loosened to allow said legs to collapse for ease of assembly stowage.

6. A golf club head protector assembly according to claim 1, wherein said plate is seven to ten inches in diameter.

* * * * *